US009126350B2

(12) United States Patent
Turulin

(10) Patent No.: US 9,126,350 B2
(45) Date of Patent: Sep. 8, 2015

(54) METHOD AND APPARATUS FOR MANUFACTURING A WOODEN CONSTRUCTION MADE OF ROD-LIKE MEMBERS

(75) Inventor: Matti Turulin, Maksniemi (FI)

(73) Assignee: Autoprod Oy, Kemi (FI)

( * ) Notice: Subject to any disclaimer, the term of this patent is extended or adjusted under 35 U.S.C. 154(b) by 340 days.

(21) Appl. No.: 13/643,519

(22) PCT Filed: May 10, 2010

(86) PCT No.: PCT/FI2010/050375

§ 371 (c)(1),
(2), (4) Date: Oct. 25, 2012

(87) PCT Pub. No.: WO2011/141614

PCT Pub. Date: Nov. 17, 2011

(65) Prior Publication Data

US 2013/0042480 A1 Feb. 21, 2013

(51) Int. Cl.
*B27F 7/15* (2006.01)
*E04C 3/17* (2006.01)

(52) U.S. Cl.
CPC . *B27F 7/155* (2013.01); *E04C 3/17* (2013.01); *Y10T 29/49625* (2015.01); *Y10T 29/49627* (2015.01); *Y10T 29/5397* (2015.01); *Y10T 29/53961* (2015.01)

(58) Field of Classification Search
CPC ..... B23P 19/04; B23P 11/00; B27F 7/15
See application file for complete search history.

(56) References Cited

U.S. PATENT DOCUMENTS 3,379,354 A 4/1968 Moehlenpah et al
3,915,444 A 10/1975 Moehlenpah (Continued)

FOREIGN PATENT DOCUMENTS

FR 2 554 754 A1 5/1985
WO 2006/136653 A1 12/2006
WO 2009/156559 A1 12/2009

OTHER PUBLICATIONS

International Search Report for parent application PCT/FI2010/050375, having a mailing date of Feb. 11, 2011.

(Continued)

*Primary Examiner* — Moshe Wilensky
(74) *Attorney, Agent, or Firm* — Andrus Intellectual Property Law, LLP

(57) ABSTRACT

In the method, grippers (110, 140) are placed on a stationary assembly table (100) and rod-like members forming a wooden construction are laid on the support of said grippers. The wooden construction can be for example a roof truss or a wall frame. The assembly table comprises a vertical fastening plane (104) to which the grippers are fastened. The fastening plane can be made of ferrous material and the grippers can be fastened to the fastening plane magnetically or by means of a suction pad gripper. The fastening of the grippers to the fastening plane, the fastening of the rod-like members to the grippers and the joint connecting the rod-like members are conducted by means of an assembly robot (200). The joint may be a nail plate joint, a nail, screw or staple joint or a glued joint. From the CAD file of the wooden construction a list of commands controlling the operation of the assembly robot is generated by means of a decompression program. The grippers belonging to the apparatus comprise first grippers (110) and second grippers (140). The first grippers comprise a frame to be fastened to the fastening plane and a supporting part fastened to the frame. The supporting part comprises a face supporting surface to be positioned against the face of the rod-like member, an edge supporting surface to be positioned against the edge surface and a pivot plate for pressing the rod-like member against the face supporting surface. The second grippers comprise a frame to be fastened to the fastening plane and a gripping bracket. The gripping bracket comprises a grip surface to be positioned against the face of the rod-like member, a lip to be positioned against the edge surface, as well as a gripping member, such as a suction pad, for adhering to the surface of the rod-like member.

10 Claims, 6 Drawing Sheets

(56) References Cited

U.S. PATENT DOCUMENTS

| | | | |
|---|---|---|---|
| 4,669,184 | A | 6/1987 | Castillo |
| 4,679,781 | A | 7/1987 | LePoire |
| 2008/0172983 | A1 | 7/2008 | Urmson |
| 2010/0030369 | A1 | 2/2010 | McAdoo et al. |

OTHER PUBLICATIONS

Written Opinion for parent application PCT/FI2010/050375, having a mailing date of Feb. 11, 2011.

Supplementary European Search Report for EP 10,85,1323 dated Nov. 18, 2013.

METHOD AND APPARATUS FOR MANUFACTURING A WOODEN CONSTRUCTION MADE OF ROD-LIKE MEMBERS

CROSS-REFERENCE TO RELATED APPLICATION

This application is the U.S. national stage application of International Application No. PCT/FI2010/050375, filed May 10, 2010, which International application was published on Nov. 17, 2011 as International Publication No. WO 2011/141614 A1 in the English language and which application is incorporated herein by reference.

FIELD

The invention relates to a method for manufacturing a wooden construction made of rod-like members, in which method grippers are placed on a stationary assembly table, and rod-like members of the wooden construction are laid on the support of said grippers, and a joint connecting the rod-like members is formed at the confleeting points of the rod-like members. The invention also relates to an apparatus used in the method.

BACKGROUND

In housebuilding, it has become more and more common to use prefabricated members i.e. elements. The elements are manufactured in prefabrication factories, whereafter they are transported to the building site and fixed as a part of the frame of the building under construction. Typical elements manufactured under plant conditions are wooden nail plate trusses. Nail plate trusses are manufactured by placing the truss chords and members in their respective places on a horizontal stationary assembly table, whereafter they are connected by means of nail plates. The nail plates are placed in their position on both sides of the connecting point and pressed in their position by means of a movable hydraulic press. In a traditional method of manufacturing roof trusses the installation of the members and chords on their position on the assembly table, placing of the nail plates at the connecting points and the pressing of the nail plates in their position are conducted manually, which increases the manufacturing costs of the trusses. By employing the method of manufacturing nail plate trusses it is also possible to manufacture other wooden structures composed of rod-like members, such as wall frames.

Publication US 2008/0172983 A1 discloses a method and a system for assembling nail plate trusses. In this solution the truss moves along a horizontal assembly line at the assembly stage. The assembly line contains several stations for the different stages of assembling the truss. Furthermore, the system contains for instance a station for sawing the members, a station for positioning the chord memburs with respect to each other, a station for positioning the diagonal and vertical members with respect to the chord members, and a station for fastening the vertical members to the chord members by means of nail plate joints. The assembly line is long and the assembly of the truss takes place in horizontal position, wherein it requires a great deal of space. The act of moving the truss on the assembly line requires fastening of the diagonal and vertical members temporarily to the chord members by means of staples before making the final nail plate joints. This additional work stage decelerates the manufacture of the truss and increases the manufacturing costs.

Publication WO 2009/156559 A1 discloses a system for manufacturing roof trusses or the like. This system comprises a vertical assembly table containing grippers, on the support of which the members and chords of the truss are fastened. The grippers are fastened to beams which can be moved vertically and horizontally and which can be pivoted in various positions. The beams, in turn, are fastened to pillars that move along the rails of a transfer line during the assembly of the truss. This system contains a large number of moving parts, whose position with respect to each other must be known accurately during the entire manufacturing stage of the truss. For this reason the system has a complex structure and it is difficult to implement its control mechanism. The moving of the truss at the assembly stage reduces especially the dimension accuracy of the joints, and makes it difficult to remain within the manufacturing tolerances.

BRIEF DISCLOSURE

It is an objective of the invention to provide a new method and apparatus for manufacturing a wooden construction made of rod-like members, by means of which it is possible to significantly reduce the drawbacks and disadvantages related to the prior art.

The objectives of the invention are achieved by a method and an apparatus which are characterized in what will be set forth in the independent claims. Some preferred embodiments of the invention will be presented in the dependent claims.

In the method according to the invention for manufacturing a wooden construction made of rod-like members, grippers are placed on a stationary assembly table, and the rod-like members forming the finished wooden construction are laid on the support of said grippers. The rod-like members are positioned on the assembly table on the support of the grippers in that position with respect to each other in which they will be in the finished wooden construction; whereafter a joint connecting the rod-like members is formed at the connecting points of the members. In the method according to the invention, the assembly table comprises a substantially vertical fastening plane to which the grippers are fastened. Thus, the assembly of the wooden construction takes place in vertical position. The fastening plane is a plate-like part and the grippers can be fastened basically to any point an the fastening plane.

In a preferred embodiment of the method according to the invention the fastening plane is manufactured of a ferrous material and the grippers are fastened to the assembly table magnetically.

In another advantageous embodiment of the method according to the invention the grippers are fastened to the fastening plane by means of a suction pad gripper located in the grippers.

In a third advantageous embodiment of the method according to the invention the grippers are fastened to the fastening plane, the rod-like members are fastened to the grippers and the joint connecting the rod-like members is formed by means of an automatic assembly robot. Advantageously, production instructions of the wooden construction are generated from the CAD file of the wooden construction by means of a decompression program and a list of commands controlling the operation of the assembly robot is generated on the basis of the production instructions.

In a fourth advantageous embodiment of the method according to the invention the manufactured wooden constructions are roof trusses, wherein the rod-like members connected by means of the method are chord or web members of the roof truss. Typically roof trusses comprise a lower chord, an upper chord and a group of web members located between the upper and lower chords. The upper and lower chords may be composed of one or several chord members connected together. In the finished truss the web members may be vertical members placed in an upright position or diagonal members placed in an inclined position. In the manufacture of roof trusses the chord and web members are supported on the fastening plane so that their face extends in parallel to the fastening plane.

In a fifth advantageous embodiment of the method according to the invention the manufactured wooden constructions are wall frames, wherein the rod-like members connected by means of the method are upper or lower crossbars of the wall frame and frame posts. In the manufacture of wall frames the upper and lower crossbars and the frame posts are supported on the fastening plane so that their edge surface is positioned in parallel to the surface of the fastening plane. The upper ends of the frame posts are fastened to the upper crossbar and their lower ends to the lower crossbar.

In a sixth advantageous embodiment of the invention, the joint connecting the rod-like members is a nail plate joint, which is formed by fastening at least one nail plate into the connecting point by pressing. Typically at least two nail plates are pressed into the connecting point so that there are an equal number of nail plates on both sides of the connecting point.

In a seventh advantageous embodiment of the invention, the joint connecting the rod-like members is a screw, nail or staple joint, which is formed by arranging in the connecting point at least one screw, nail or staple extending from the first rod-like member to a second rod-like member.

In an eighth advantageous embodiment of the invention, the joint connecting the rod-like members to each other is a glued joint, which is formed by dispensing adhesive on at least one of the surfaces placed against each other in the joint and pressing the surfaces connecting in the joint against each other. The surfaces of the rod-like members placed against each other in the joint may contain notches or grooves that increase the adhesive surface in the joint.

The apparatus according to the invention for manufacturing a wooden construction made of rod-like members comprises a stationary assembly table, several movable grippers fastened on the assembly table for gripping the rod-like members, and means for forming a joint connecting the rod-like members. The assembly table of the apparatus comprises a frame and a substantially vertical fastening plane mounted on the frame to which fastening plane the grippers are fastened.

The planar fastening plane enables fastening the grippers in principle to any location on the fastening plane. Advantageously, the fastening plane is composed of modules placed next to each other, and the size of the fastening plane can be adjusted by changing the number of the modules. The assembly table may comprise two fastening planes, wherein the first fastening plane is located on one side of the frame and the second fastening plane on the other side of the frame.

In an advantageous embodiment of the apparatus according to the invention the fastening plane is manufactured of a ferrous material and the grippers contain a magnet, advantageously an electromagnet by means of which the grippers can be fastened to the fastening plane.

In a second advantageous embodiment of the apparatus according to the invention the grippers comprise a suction pad gripper for adhering to the fastening plane. The suction pad gripper comprises a suction pad whose open mouthpiece is placed against the surface of the fastening plane. When air is sucked out of the suction pad, it adheres on the surface of the fastening plane. The negative pressure required in the suction gripper can be generated by means of a vacuum pump arranged in connection with the gripper or the vacuum pump may be integrated in the suction pad gripper. The vacuum pump may be for example electrically or pneumatically operated. The suction pad gripper comprising an electrically operated vacuum pump may be equipped with a battery, wherein it can operate in a completely wireless manner.

A third advantageous embodiment of the apparatus according to the invention comprises at least one assembly robot for placing the grippers in the predetermined locations on the fastening plane and for fastening the rod-like parts in the grippers. The assembly robot advantageously comprises an articulated arm and a gripping tool fastened to the articulated arm for fastening to the gripper.

In a fourth advantageous embodiment of the apparatus according to the invention said grippers comprise first grippers comprising a frame to be fastened to the fastening plane and a supporting part fastened to the frame for gripping a rod-like member such as a chord member. Advantageously said supporting part comprises a face supporting surface to be positioned against the face of the rod-like member, an edge supporting surface to be positioned against the edge surface of the rod-like member and a pivot plate for pressing the rod-like member against the face supporting surface.

In a fifth advantageous embodiment of the apparatus according to the invention said grippers comprise second grippers comprising a frame to be fastened to the fastening plane and a gripping bracket for gripping a rod-like member, such as a web member. Advantageously said gripping bracket comprises a grip surface to be positioned against the face of the rod-like member, a lip to be positioned against the edge surface of the rod-like member as well as a gripping member, such as a suction pad, for gripping the surface of a rod-like member.

In a sixth advantageous embodiment of the apparatus according to the invention, said means for forming the joint connecting the rod-like members comprise a press tool for pressing the nail plates in their position.

In a seventh advantageous embodiment of the apparatus according to the invention, said means for forming the joint connecting the rod-like members comprise a nailer, stapler and/or a screwdriver.

In an eighth advantageous embodiment of the apparatus according to the invention, said means for forming the joint connecting the rod-like members comprise a dispenser for adhesive. Advantageously, all the above-mentioned means for forming the joint connecting the rod-like members can be attached to the articulated arm of an assembly robot.

A ninth advantageous embodiment of the apparatus according to the invention also comprises an automatic control unit for controlling the operation of the grippers, the assembly robot and the tools attached to the articulated arm of the assembly robot.

It is an advantage of the invention that by means of the invention it is possible to manufacture wooden constructions made of rod-like members fully automatically, wherein savings can be attained in labour costs. Thanks to the stationary assembly table the manufacturing method is dimensionally accurate, which makes it easier to remain within the manufacturing tolerances and minimizes the number of rejected products.

It is an advantage of the apparatus according to the invention that it requires a small amount of space. Thus, savings are attained in costs relating to space.

Yet another advantage of the invention is that it has a modular structure and can be easily expanded. The size of the assembly table can be increased in a flexible manner and if necessary, it is possible to position several assembly tables one after the other.

Furthermore, it is an advantage of the invention that the fastening of the grippers magnetically or by means of negative pressure to the fastening plane sets only a few restrictions for the placement of the grippers. Thus, the invention enables automated manufacture of various types of wooden constructions of complex design such as roof trusses that are composed of rod-like members.

BRIEF DESCRIPTION OF THE DRAWINGS

In the following, the invention will be described in detail. In the description, reference will be made to the accompanying drawings, in which.

DETAILED DISCLOSURE

Figure 1:
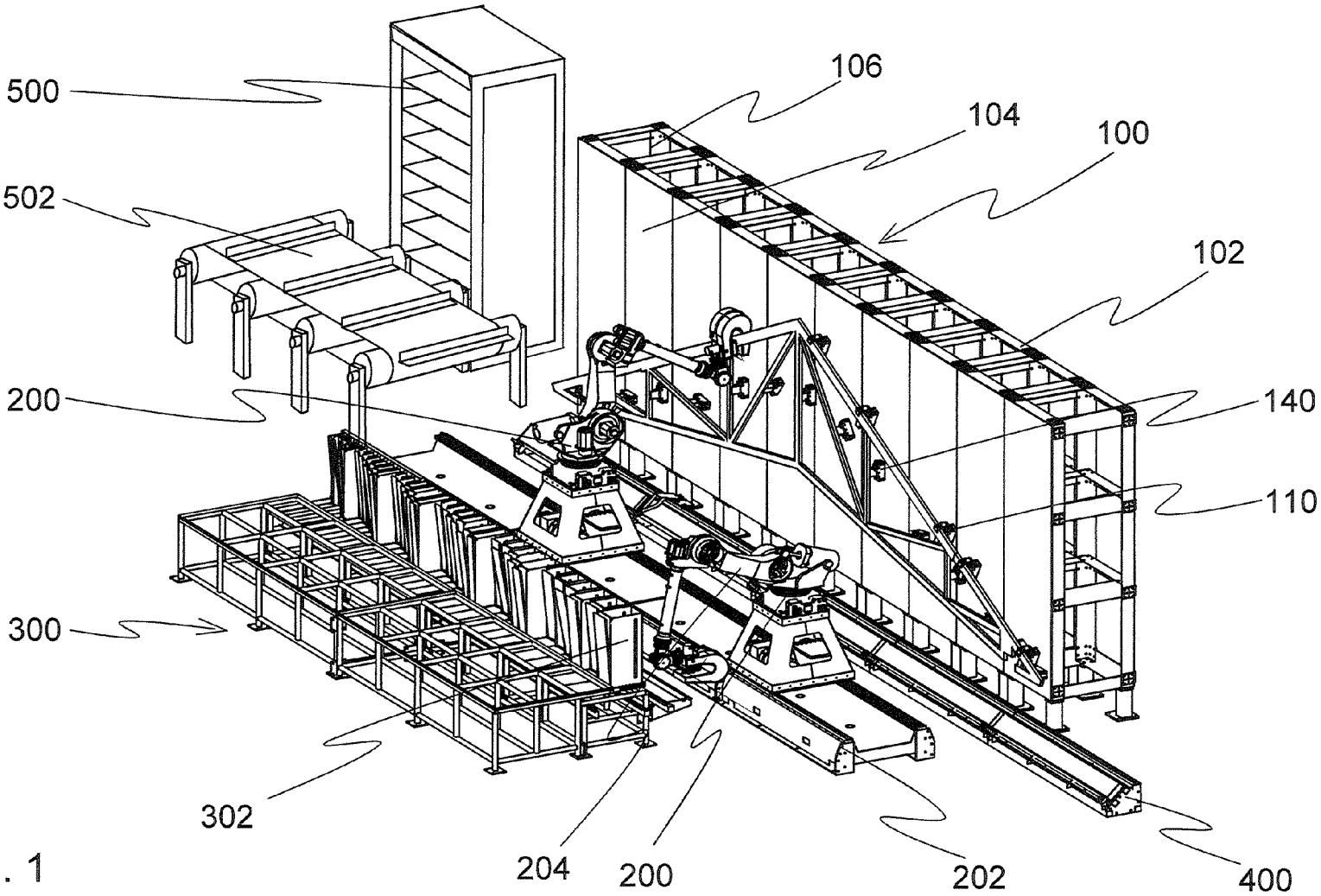
FIG. 1 shows, as an example an apparatus according to the invention in a slanted view from above.

FIG. 1 shows, as an example, an apparatus according to the invention in a slanted view from above. The apparatus comprises an assembly table 100, comprising a frame 102 and a planar, substantially upright fastening plane 104 fastened on the surface of the frame. The frame is a rigid framework composed of rod-like members, standing on the support of supporting legs on top of a surface, such as the floor of an assembly hall. The fastening plane is a part having a flat surface which is fixed on one side of the frame and made of ferrous material. Advantageously, the fastening plane is made of a 15 mm thick steel plate. The assembly table has a modular structure, in other words, it is composed of several modules 106 placed next to each other. The width of the fastening plane of one module is 1.2 meters and the height 4 meters. In the assembly table of FIG. 1 there are 10 modules placed next to each other, wherein the width of the fastening plane is 12 meters and the height four meters. This size of the assembly table is sufficient for the manufacture of the majority of roof trusses. The size of the assembly table can be easily adjusted by changing the width and/or height of the module 106 or increasing or reducing the number of modules 106.

The apparatus also comprises at least one assembly robot 200, by means of which the trusses are assembled automatically. In the apparatus shown in FIG. 1, there are two assembly robots. Next to the assembly table there are transfer rails 202 extending in parallel to the assembly table, along which the assembly robots can move in parallel to the transfer rails. The length of the transfer rails is dimensioned in such a manner that all sections of the fastening plane extend within the operating range of at least one assembly robot. The assembly robot comprises an articulated arm 204, having at its free end a socket for fastening different kinds of tools. The assembly robot contains a computer-controlled control system, by means of which the operation of the assembly robot and the tools fastened thereto is controlled. The structure and operation of computer-controlled industrial robots is known as such and therefore it will not be described in more detail in this context.

The apparatus also comprises a nail plate storage 300, comprising several nail plate magazines 302 arranged next to each other in a line parallel to the transfer rails 202 on the other side of the transfer rails. There is a separate nail plate magazine for each individual nail plate of different type. The distance of the nail plate magazines from the transfer rails is dimensioned in such a manner that the nail plate magazines are within the reach of the articulated arm 204 of the assembly robot.

The apparatus according to the invention also comprises a member storage 500 and a discharge conveyor for the finished truss. The member storage is a storage rack arranged at the first end of the assembly table, containing a separate shelf for each chord member or web member used in the manufacture of the truss. The member storage is provided with a conveyor 502 which transfers the member being processed at the time to the end of the conveyor. There is a rotary table at the end of the conveyor, which moves the member from the conveyor to the member conveyor 400 (rotary table not shown in the Figure). The member conveyor is an elongated, rail-like transfer means positioned in parallel to the assembly table between the assembly table and the transfer rails 202. The member conveyor transfers the member being processed at a given time from the conveyor 502 within the reach of the assembly robot. The discharge conveyor may be any suitable conveyor arranged in connection with the assembly table, for example a lifting means moving along rails, by means of which the finished nail plate truss can be transferred from the assembly table to the storage. The discharge conveyor is not shown in the figure.

Figure 2A:
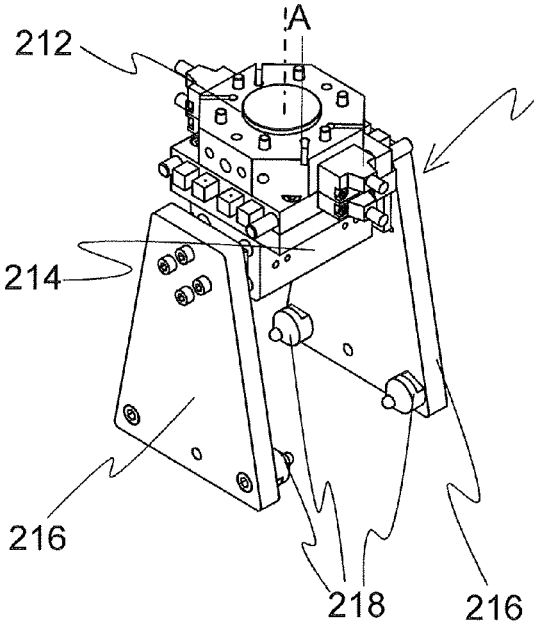
FIGS. 2*a* and 2*b* show, as an example, a gripping tool belonging to the apparatus according to the invention, viewed from different directions.
Figure 2B:
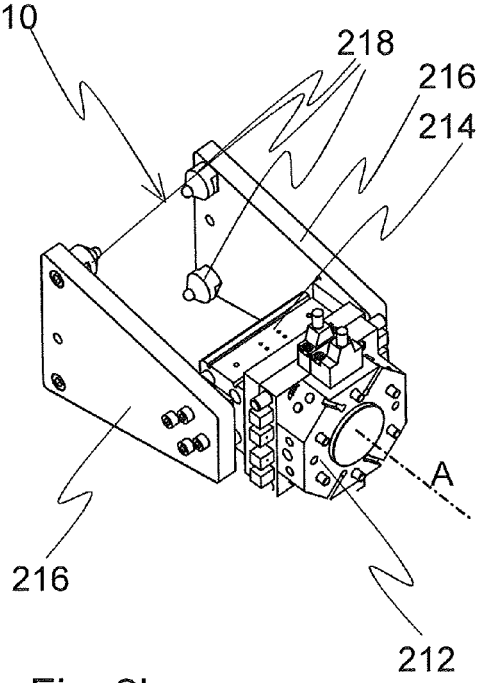

FIGS. 2*a* and 2*b* show a gripping tool 210 to be fastened to an assembly robot 200 belonging to the apparatus according to the invention. The gripping tool comprises a fastening socket 212 by means of which it is fastened to the free end of the articulated arm 204 of the assembly robot. On the other surface of the fastening socket there is a frame part 214 having gripping plates 216 fastened to its opposite edges. The frame part 214 is fastened to the fastening socket in such a manner that it can rotate around a rotation axis A in relation to the fastening shaft. There are two gripping brackets 218 on the opposite surfaces of the gripping plates. The gripping plates have been mounted on the frame part in a movable manner so that their mutual distance can be changed, in other words, the gripping plates can be moved towards or away from each other. The gripping tool also comprises actuators for moving the gripping plates (actuators not shown in the figures). Advantageously, said actuators are pneumatical actuators.

Figure 2C:
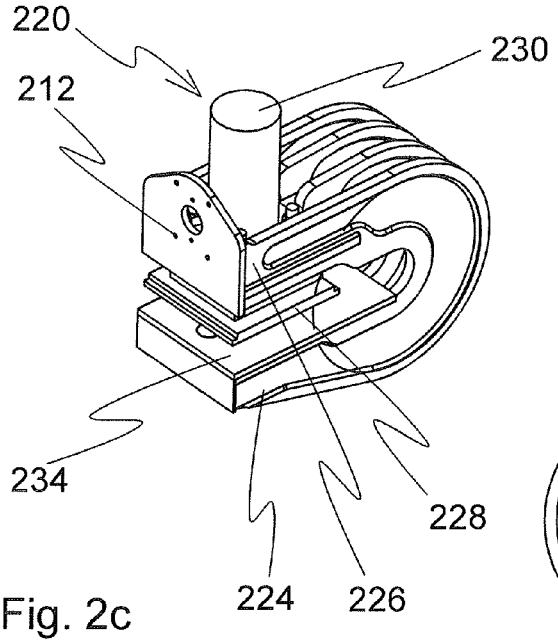
FIGS. 2*c* and 2*d* show, as an example, a press tool belonging to the apparatus according to the invention.
Figure 2D:
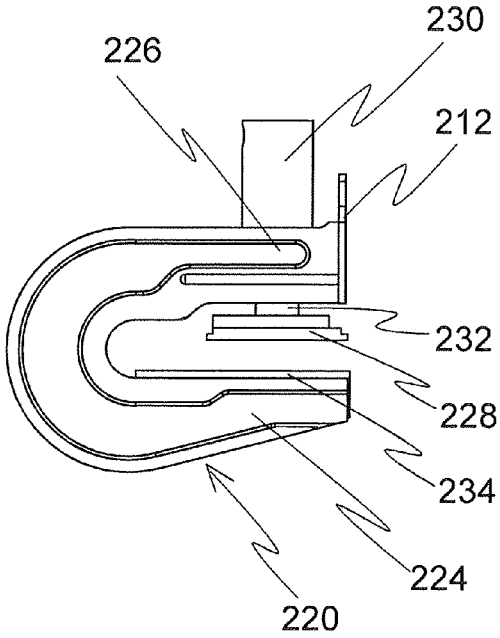

FIG. 2*c* shows a press tool 220 to be fastened to the assembly robot, said press tool comprising a fastening socket 212 similarly to the gripping tool, by means of which it can be fastened to the free end of the articulated arm 204 of the assembly robot. The press tool has a frame having a shape resembling letter C, comprising a stationary lower jaw 224 and an upper jaw 226, and between the jaws there is a clear opening. The fastening socket 212 is mounted to the free end of the upper jaw. The upper jaw also comprises a hydraulic cylinder 230 extending crosswise with respect to the longitudinal axis of the upper jaw so that the free end of the piston 232 protruding from the hydraulic cylinder is positioned in the opening between the upper jaw and the lower jaw. The free end of the piston comprises a press plate 228 in which a permanent magnet is placed. On the other surface of the lower jaw on the side of upper jaw there is a backing plate 234 comprising an electromagnet. The press plate and the backing plate are positioned in the jaws of the press tool so that by means of moving the piston of the hydraulic cylinder it is possible to move the press plate towards the backing plate or away from the same. The press tool also includes hydraulic hoses through which hydraulic oil is conveyed to the hydraulic cylinder (hydraulic hoses not shown in the figure).

Figure 3A:
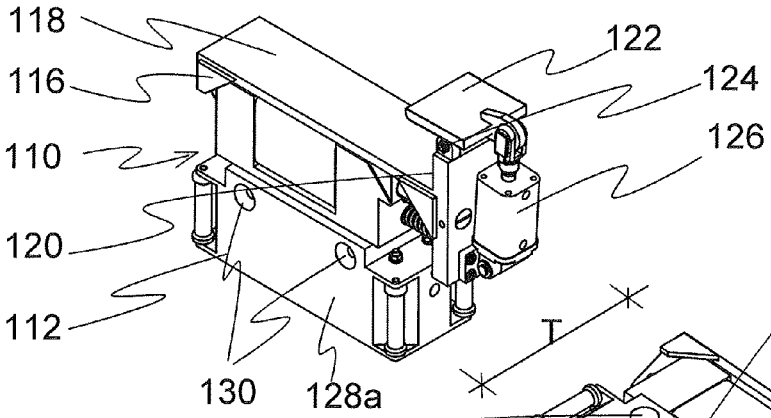
FIGS. 3*a* and 3*b* show, as an example a first gripper belonging to the apparatus according to the invention, viewed from different directions.
Figure 3B:
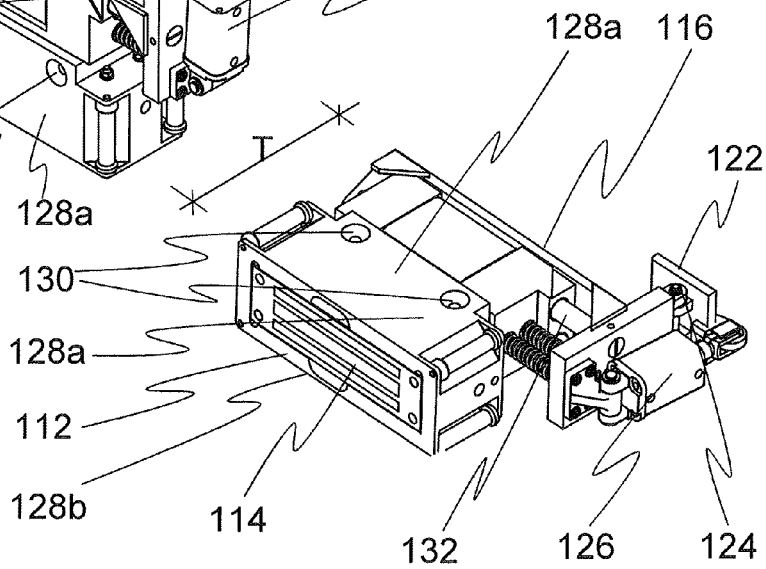

FIGS. 3*a* and 3*b* show a first gripper 110 to be fastened to the fastening plane of the assembly table, viewed from two different directions. The first gripper comprises a box-like frame 112 with a substantially flat first side. This first side contains an electromagnet 114. The electromagnet is positioned primarily inside the box-like frame so that its surface protruding from the frame is positioned substantially in parallel to the first side of the frame. The box-like frame comprises two opposite edge surfaces 128*a*, 128 extending in parallel and at a right angle with respect to the first side. These edge surfaces comprise two locking notches 130, the shape of which corresponds to the shape of the gripping brackets 218 of the gripping tool 210, and their mutual distance equals the mutual distance of the gripping brackets of the gripping tool. By means of the gripping tool it is possible to grip the gripper of the chord member by placing the frame 112 of the gripper of the chord member between the gripping plates 216 and moving the gripping plates towards each other so that the gripping brackets are positioned in the locking notches.

On the other side of the box-like frame there is the supporting part 116 of the chord member, which comprises a face supporting surface 118 an edge supporting surface 120 and a pivot plate 112. The face supporting surface and the edge supporting surface are planar parts fixed to each other in such a manner that they are in a substantially perpendicular position with respect to each other. The face supporting surface extends substantially parallel to the first side of the frame and it is located within a supporting distance T from the first side of the frame. The supporting distance can be between 50 to 500 mm, advantageously the supporting distance is 200 mm. The pivot plate 122 is fastened to the other end of the edge supporting surface 120 by means of an articulated shaft 124. On one surface of the edge supporting surface there is a pneumatic cylinder 126 whose cylinder part is fastened to the edge supporting surface and the end of the piston part is fastened to the pivot plate. By means of the pneumatic cylinder it is possible to turn the pivot plate to a first position in which the pivot plate extends in parallel to the edge supporting surface and to a second position in which the pivot plate forms a right angle with the edge supporting surface and in which it is parallel to the face supporting surface. The supporting part 116 of the gripper is fastened to the frame 112 by means of rod-like guides 132 so that the supporting part can be moved along the rails with respect to the frame 112. The moving of the supporting part takes place by means of a pneumatic actuator located inside the frame. The first gripper also comprises electrical cables for conducting electric current to an electromagnet 114 and pneumatic hoses for conveying pressurized air to the pneumatic cylinder 126 and to the pneumatic actuators. The electrical cables and the pneumatic hoses are not shown in the figures.

Figure 3C:
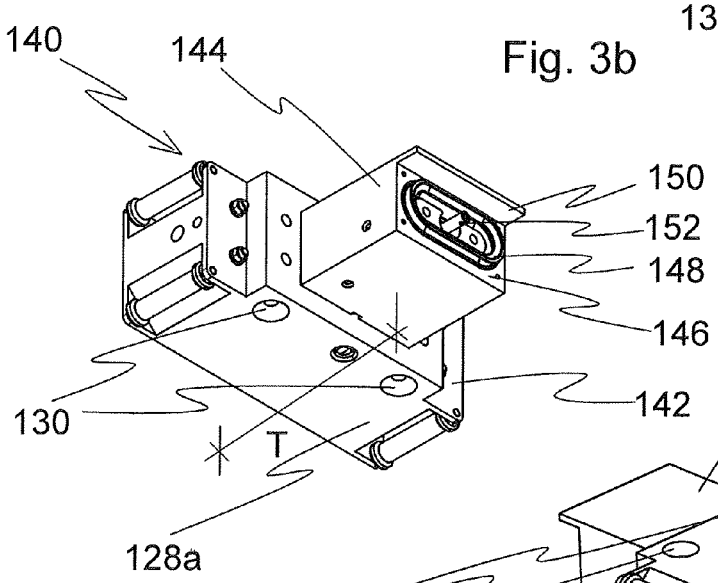
FIGS. 3*c* and 3*d* show, as an example, a second gripper belonging to the apparatus according to the invention, viewed from different directions, FIGS. 4*a* 4*b* and 4*c* shown example, the steps of the method according to the invention in schematic views.
Figure 3D:
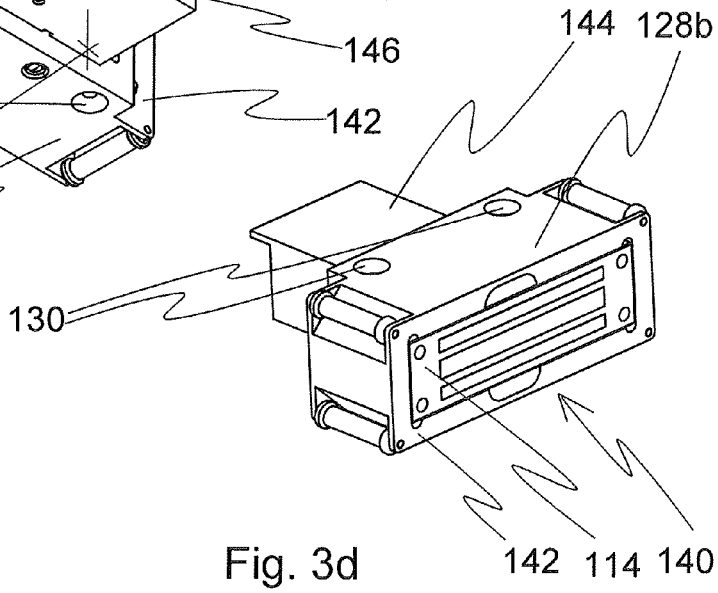

FIGS. 3*c* and 3*d* show a second gripper 140 to be fastened to the fastening plane of the assembly table, viewed from two different directions. The second gripper cornprises a box-like frame 142 having a first side and two parallel edge surfaces 128*a*, 128*b* which are at a right angle with the first side. The first side contains an electromagnet 114 and the edge surfaces contain two locking notches 130 for gripping by means of the gripping tool 210. On the second side of the second gripper there is a gripping bracket 144 having a rectangular grip surface 146 at its free end. The grip surface is substantially parallel to the first end of the frame and it is located within a supporting distance T from the first side. Inside the gripping bracket there is a suction pad 148 whose mouthpiece opens on the grip surface so that the surface of the truss member positioned against the grip surface is always positioned against the mouthpiece of the suction pad. From the centre of the suction pad a suction line 152 extends inside the gripping bracket, through which air can be sucked away from the suction pad, wherein the suction pad adheres on the surface of the member positioned against its opening. The first edge surface of the grip surface contains a lip 150 on which the edge of the member positioned against the grip surface can be supported. The second gripper also comprises electrical cables for conducting electric current to the electromagnet 114 and pneumatic hoses for conveying pressurized air to the actuator connected to the suction line. The electrical cables, the pneumatic hoses and the actuator are not shown in the figures.

FIG. 4 shows, as an example, the steps preceding the actual assembly of the truss in a simple flowchart. The initial information required in the method includes the basic order data, such as the number of nail plate trusses to be manufactured and the desired time of delivery, as well as the design data of the nail plate truss in a CAD file 550. This information is typically delivered to the assembly unit automatically from the production control system. The order is placed in the production line of the assembly unit and at the same time production instructions 554 of the nail plate truss are automatically generated on the basis of the CAD file by means of a separate CAD decompression program 552. The production instructions of the nail plate truss comprise the members and nail plates necessary for manufacturing the truss, as well as the order in which they are installed and the locations where they are placed. The production line and production instructions are stored in the database 556. Each nail plate truss type has production instructions of its own.

Figure 4A:
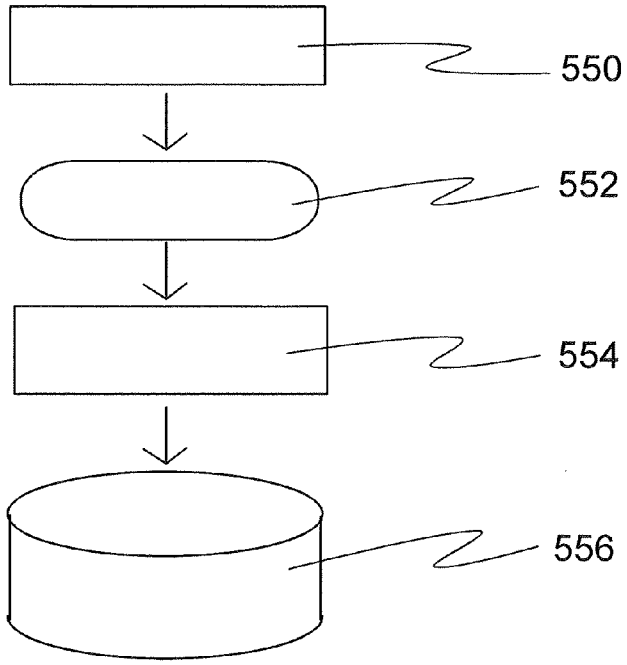
Figure 4B:
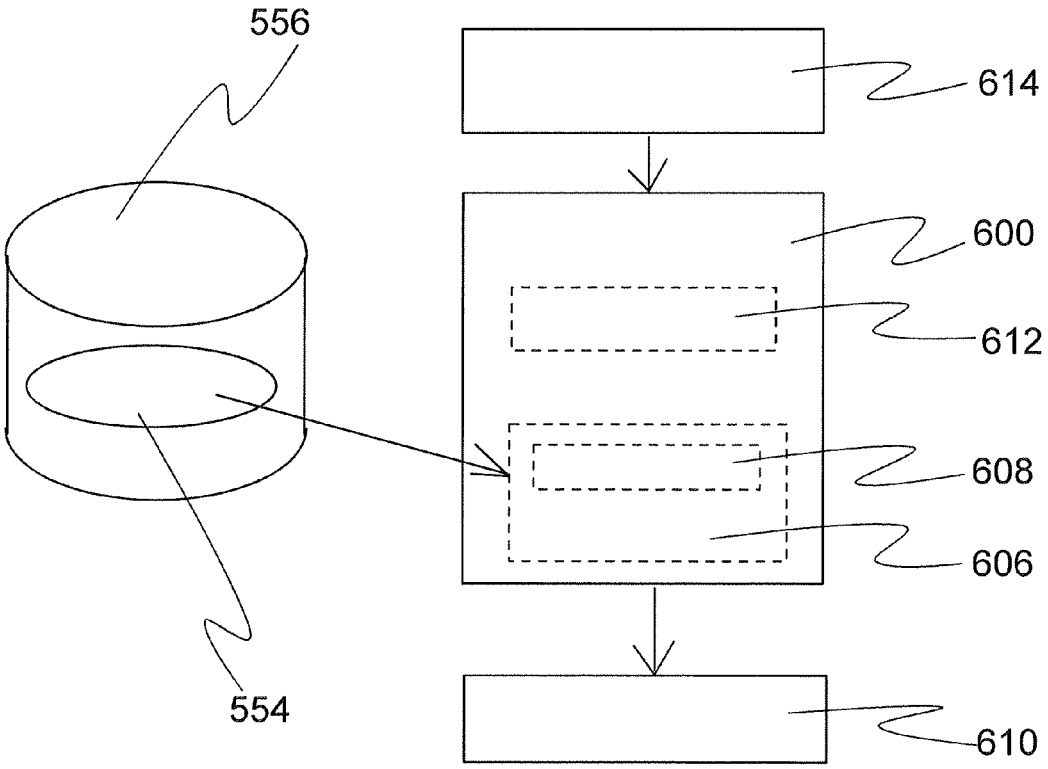

FIG. 4*b* illustrates, as an example, the control of the apparatus according to the invention in a schematic view. The apparatus is controlled by means of an automatic control unit 600 belonging to the same, and by means of a production program 608 loaded in its memory 606. The control unit naturally also comprises a processor 612 for processing information and a user interface 614 for giving control commands.

A list of commands 610 is automatically generated on the basis of the production instructions 554 by means of a program, and the list is formed when the production instructions produced by the operating model shown in FIG. 4*a* are adapted to the assembly unit by means of a program. The adaptation means that the physical control of the assembly unit is combined with the production instructions obtained from the CAD file. The list of commands is composed of the control commands of the assembly unit that control the automatic assembly of the roof trusses.

The order handling, CAD files and the production line are controlled by means of the user interface 614. Through the user interface it is also possible to start up and stop the production of nail plate trusses and to control the production line. The apparatus starts up when the command "start" is given from the user interface. Then the production control system automatically retrieves the production instructions of the nail plate truss series next in the production line and automatically forms a list of commands on the basis of the same. Thereafter the production control unit sends control commands to the actuators in the order indicated in the list of commands and the actuators perform the assembly tasks on the basis of the commands. The assembly of the nail plate truss ceases and the truss is finished when all the control commands in the list of commands have been performed. Thereafter the nail plate truss is ready to be transferred to the storage and the assembly of a new nail plate truss can begin. The assembly of the nail plate truss can be stopped at any stage during the assembly by giving the command "stop" from the user interface.

Figure 4C:
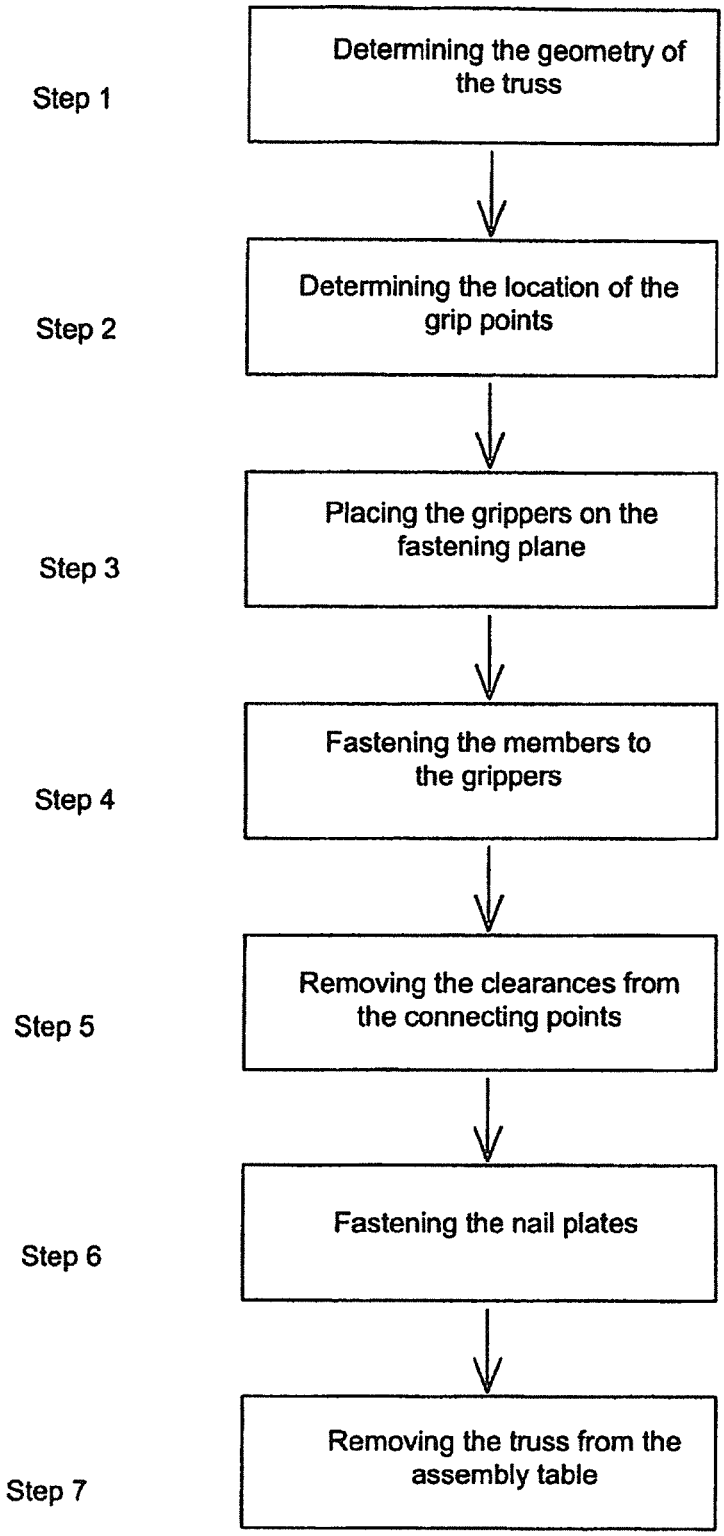

FIG. 4*c* shows, as an example, the different steps in the assembly of the nail plate truss manufactured by means of the method according to the invention in a flow chart. The assembly of the truss takes place on an assembly table 100, for which a two-dimensional position coordinates system (x, y) has been determined. In step one the geometry of the truss is determined in the position coordinates system (x, y) of the assembly table. The geometry of the truss comprises the dimensions and location of the upper chord and the lower chord of the truss, the dimensions and location of the web members of the truss and the location of the connecting points of the members of the truss, i.e. so-called nodes in the position coordinates system.

In step two the location of the grip points ($x_t$, $y_t$, □$_t$) of the chord members and the web members in the position coordinates system of the assembly table are determined. The term "grip point" refers to those points of the chord and web members of the truss which are gripped by the first grippers 110 and the second grippers 140. The location of the grip points is selected in such a manner that the grip point is not located at the connecting point of the members of the truss, nor in its immediate vicinity. Another aspect restricting the location of the grip points is the size of the assembly table and the number of grippers in use. The number of grippers in the apparatus is in basic build-up dimensioned in such a manner that for each 1.2 m wide module 106 of the assembly table there are two first grippers 110 and two second grippers 140. Thus, when the location of the grip points is determined, the part of the truss positioned on the 1.2 m wide module 106 is always viewed at a time and the location of the gripper of the upper chord member of the truss and the gripper of the lower chord member is determined for this module as points in the system of coordinates ($x_t$, $y_t$, □$_t$). In addition to the location of the grippers, the point in the system of coordinates also indicates the position of the gripper, in other words its rotational angle □□ around the axis parallel to the normal of the fastening plane. When determining the position of the grippers, the difference in the way how the upper chord and the lower chord of the truss fasten to the grippers must also be taken into account. The first gripper used for supporting the lower chord of the truss is fastened to the fastening plane in such a position that the edge supporting surface 120 (FIGS. 3*a*, 3*b*) is positioned against the edge of the lower chord facing downward. Similarly, the first gripper used for supporting the upper chord of the truss is fastened to the fastening plane in such a position that its edge supporting surface is positioned against the edge of the upper chord facing upwards.

By the same principle, the locations of the second grippers placed on said module under examination are determined in points in the system of coordinates ($x_t$, $y_t$, □$_t$). The location of the second grippers on the fastening plane are determined in such a manner that the lip 150 of the gripping bracket 8 (FIGS. 3*c*, 3*d*) is positioned against the edge surface of the web member.

In step three the first grippers 110 and the second grippers 140 are positioned on the fastening plane 104 in the locations determined above. The placement of the grippers takes place by means of an assembly robot 200. For the duration of placing the grippers, a gripping tool 210 is fastened to the articulated arm of the assembly robot. The assembly robot grips the first chord member gripper 1103 by means of the gripping tool and places it in the correct location and position on the fastening plane 104 so that the electromagnet 114 of the gripper is positioned against the surface of the fastening plane 104. During the placement no electric current is conveyed to the electromagnet, wherein it is possible to move the gripper along the surface of the fastening plane at the placement stage. When the gripper has been transferred in the correct location and position on the fastening plane, current is switched on in the electromagnet, wherein the first gripper adheres in a stationary manner in its place on the fastening plane in the predetermined point in the system of coordinates ($x_t$, $y_t$, □$_t$). Thereafter the gripping tool 210 loosens its grip from the first gripper and grips the next gripper and places it in the point in the system of coordinates ($x_t$, $Y_t$, □$_t$) determined for this gripper in the manner described above. After fastening the first grippers the assembly robot fastens the second grippers in their place.

Figure 5A:
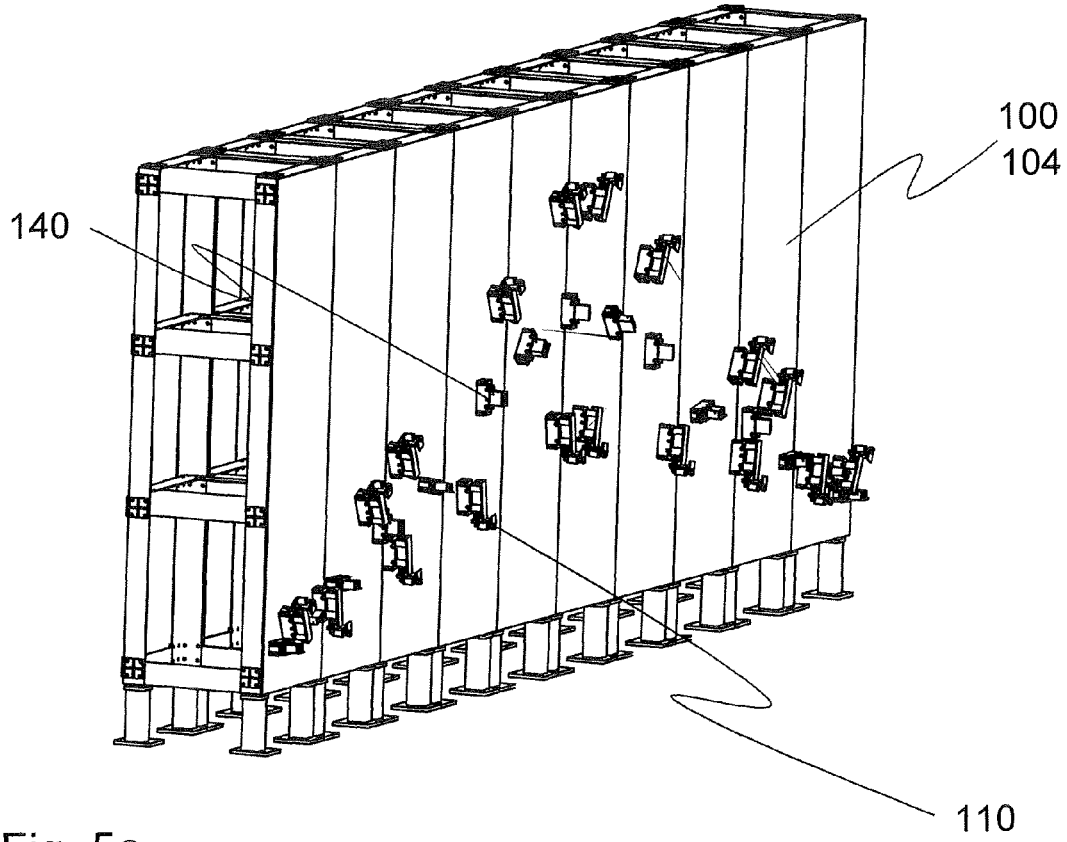
FIGS. 5*a* and 5*b* show the assembly table of the apparatus according to the invention at different stages of the assembly.

The fastening of the grippers on the fastening plane can be performed in any order appropriate in view of the operation of the assembly robot. Thus, the grippers can be fastened in their place for example in such a manner that the grippers of one module 106 of the fastening plane are fastened in their places successively, whereafter the next module is in turn. Alternatively, all first grippers to be placed on the fastening plane can be fastened first, and the second grippers after that. The essential aspect in the act of fastening the grippers is that the as a result of the step 3, a composition, i.e. a jig formed of the first grippers and the second grippers has been produced on the fastening plane, on which jig all individual members of the truss can be fastened by means of at least one, typically two, three or four grippers (FIG. 5*a*).

The fastening of the grippers is followed by step four in which the members of the truss, i.e. chord members and web members are fastened to the grippers of the fastening plane. The fastening of the truss members takes place by means of a computer-controlled assembly robot 200 one truss member at a time so that at first, all chord members are fastened in their place and after that the web members are fastened between the chord members. The conveyor 502 of the member storage 500 and the member conveyor 400 transfer the first chord member of the truss within the reach of the articulated arm of the assembly robot and the assembly robot grips it with the gripping tool. Thereafter the assembly robot places the chord member in its place against the first grippers so that the face of the member is positioned against the face supporting surface 118 of the gripper and the edge of the member is positioned against the edge supporting surface 120 of the gripper (FIG. 3*a*, 3*b*). At the stage of positioning the member, the pivot plate 122 of the first gripper is in a first position in parallel to the edge supporting surface. When the member has been positioned in the correct location against the grippers, the pivot plate is turned to a second position in parallel to the face supporting surface, wherein the chord member remains pressed between the face supporting surface and the pivot plate, being thus locked in its place in a stationary manner. Thereafter the gripping tool releases its grip from the first chord member and grips the next chord member which has been transferred within the reach of the articulated arm of the assembly robot by means of the member conveyor 400. All chord members are fastened in their places successively in the manner disclosed above.

Figure 5B:
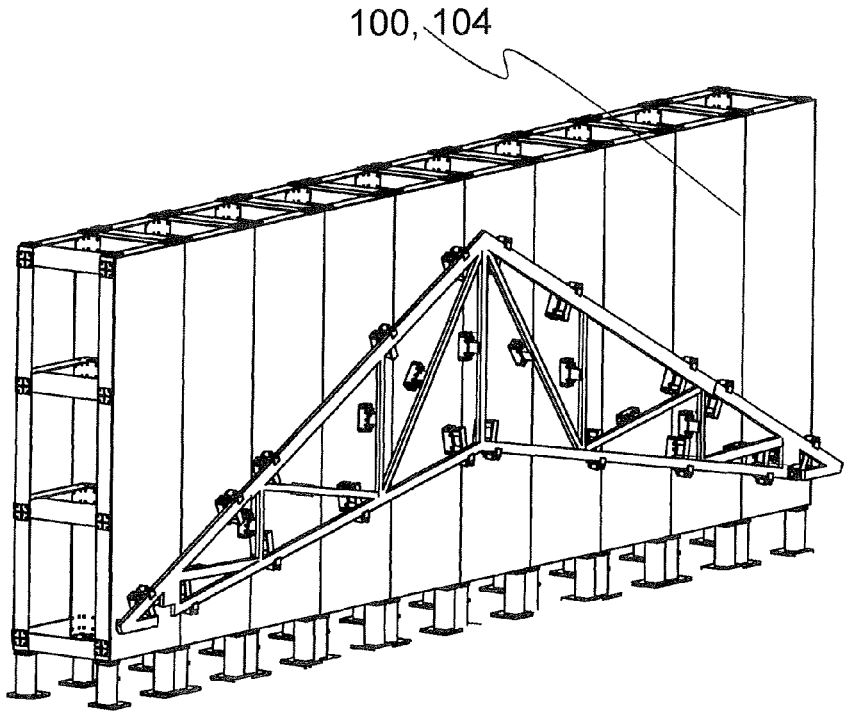

After fastening the chord members, the web members are positioned in their place, which web members can be vertical members placed in an upright position or diagonal members placed in an inclined position. In principle, the placement of the web member takes place similarly to the placement of the chord members, in other words the conveyor 502 transfers a web member from the member storage on the member conveyor 400, which then transfers the member further within the reach of the assembly robot. The assembly robot grips the member by means of the gripping tool and places it in its predetermined position on the fastening plane so that the face of the member is positioned against the grip surface 146 of the gripper and the edge surface of the member is supported on the lip 150. Thereafter air is sucked out of the suction pad of the gripper, wherein the member adheres to the second gripper in a stationary manner and the gripping tool can release its grip from the member. All web members of the truss are fastened in their place successively in a similar manner. As a result of the step four all members belonging to the truss are on the fastening plane supported in their places in a stationary manner (FIG. 5*b*). The members can also be fastened to the grippers in an order different from that described above, if it is appropriate in view of the manufacture of the truss.

In step five, the clearances in the connecting points are removed. In the removal of the clearances, the upper chord members and the lower chord members are transferred slightly towards each other, wherein the edge surfaces of the chord members are pressed tightly against the end surfaces of the diagonal members and vertical members located between the chord members. Thus, by removing the clearances it is ensured that no gaps remain between the edge surfaces of the chord members and the end surfaces of the web members, which gaps would significantly impair the bearing capacity of the finished truss. The removal of the clearance is conducted by moving the supporting parts 116 of the grippers 110 with respect to their frame 112 so that the possible gaps between the edge surfaces of the chord members and the end surfaces of the web members are closed up. In step five it is possible to provide the truss with precambers or prestresses, to compensate the bending occurring in the truss in use. The precambers are formed in such a manner that the chord member is bent to a desired direction by means of the movable supporting parts of the first grippers. Typically, the precamber is used in the lower chords of the nail plate trusses, which can be provided with a slightly upward curved shape at the manufacturing stage.

In step six the nail plates are placed in their positions at the connecting points. For fastening the nail plates, the gripping tool in the articulated arm 204 of the assembly robot 200 is replaced with a press tool 220 (FIG. 2*c*). The assembly robot transfers the press tool at the location of the nail plate magazine 302 containing suitable nail plates so that the loading shelf of the nail plate magazine is positioned as an extension of the lower jaw 224 of the press tool. Thereafter the nail plate magazine pushes from the magazine a nail plate pair on top of the backing plate 234 of the lower jaw, said nail plate pair comprising two nail plates facing each other with the spiky sides against each other. Electric current is switched on in the electromagnet of the backing plate, wherein the lower nail plate of nail plate pair adheres to the backing plate. The press plate 228 of the upper jaw is brought in contact with the upper nail plate, wherein the upper nail plate adheres to the permanent magnet of the press plate. Both nail plates necessary for forming the nail plate joint are now fastened to the jaws of the press tool.

The assembly robot now transfers the press tool at the location of the joint to be formed so that the lower jaw 224 is on the first side of the members of the truss in the gap between the members and the fastening plane 104 and the upper jaw is on the other side of the members of the truss. The grip distance T between the first grippers 110 and the second grippers 140 is dimensioned in such a manner that the gap remaining between the fastening plane and the members of the truss is so large that the lower jaw of the press tool bearing the nail plate has enough space to move into this gap. Then the press plate 228 of the upper jaw 226 is transferred towards the backing plate 234 and the spikes of the nail plate sink into the members. Thus, a nail plate joint formed of two nail plates is formed in the connecting point. When the joint has been formed, the press plate is transferred back towards the upper jaw and the current is switched off from the electromagnet of the lower jaw. Next, a new nail plate pair is retrieved into the press tool from the nail plate storage to produce the next nail plate joint. The process continues until all nail plate joints have been finished. The pressing of the small nail plates is typically conducted in one pressing action in the manner described above. Large nail plates can be pressed in their places in stages with two or several successive pressing actions. The pressure force of the press tool can be regulated between the pressing actions, if necessary. As a result of the step five, the fastening plane holds a finished nail plate truss, which remains stationary on the fastening plane as it is fastened to the grippers.

In step seven the truss is gripped by means of a lifting means of a discharge conveyor, and the truss is released from the grip of the grippers. The releasing from the grippers takes place in such a manner that the pivot plates of the first grippers 110 are turned in a position parallel to edge supporting surface and air is released in the suction pads of the second grippers 140. Thereafter the truss is transferred on the transfer conveyor slightly away from the fastening plane, wherein it is released from the grippers. The nail plate truss can now be transferred to quality inspection, and thereafter further to a storage to wait for transportation to the client. The assembly of the next truss can begin on the fastening plane 100.

FIG. 5 shows, as an example, the assembly table 100 of the apparatus according to the invention in the end of the above-described assembly step three. As a result of the step three, all first grippers 110 and second grippers 140 necessary for supporting the members of the truss at the later assembly stages have been fastened to the fastening plane.

FIG. 5*b* shows, as an example, the assembly table 100 of the apparatus according to the invention in the end of the above-described assembly step five. In this step all the members of the truss have been placed in their correct locations on the assembly table and the clearances have been removed. At the next stage the nail plates are pressed in their places in the joints, whereafter the truss is finished.

Some of the advantageous embodiments of the method and apparatus according the invention have been described above. The invention is not restricted to solutions described above, but the inventive idea can be applied in numerous ways within the scope defined by the claims.

The invention claimed is:

1. A method for manufacturing a wooden truss structure made of rod-like members, the method comprising: placing grippers on a stationary assembly table, on the support of which grippers the rod-like members of the wooden truss structure are laid, and forming a joint connecting the rod-like members at a connecting point of the rod-like members, wherein the assembly table comprises a substantially vertical fastening plane and the grippers are fastened to said vertical fastening plane, and the rod-like members are laid on support of the grippers leaving a gap for a press tool between the fastening plane and the rod-like members.

2. The method according to claim 1, wherein the fastening plane is made of ferrous material and comprising fastening the grippers to the fastening plane magnetically.

3. The method according to claim 1, comprising fastening the grippers to the fastening plane by means of a suction pad gripper.

4. The method according to claim 1, comprising fastening the grippers to the fastening plane, fastening the rod-like members to the grippers and forming the joint connecting the rod-like members by means of an automatic assembly robot.

5. The method according to claim 1, wherein the wooden truss structure is a roof truss and wherein the rod-like members are chord or web members of the roof truss.

6. The method according to claim 1, wherein the wooden truss structure comprises a wall frame and frame posts and wherein the rod-like members are upper and lower crossbars of the wall frame and frame posts.

7. The method according to claim 1, wherein the joint connecting the rod-like members is a nail plate joint, which is formed by fastening at least one nail plate to the connecting point by pressing.

8. The method according, to claim 1, wherein the joint connecting the rod-like members is a screw, nail or staple joint, which is formed by arranging to the connecting point at least one screw, nail or staple extending from the first rod-like member to the second rod-like member.

9. The method according to claim 1, wherein the joint connecting the rod-like members is a glued joint, which is formed by dispensing, adhesive on at least one of a surface placed against each other in the joint and pressing the surfaces connecting in the joint against each other.

10. The method according to claim 4, comprising generating production instructions of the wooden truss structure from the CAD file of the wooden construction by means of a decompression program and compiling a list of commands controlling the operation of an assembly robot on the basis of the production instructions.

* * * * *